US005858196A

United States Patent [19]

Ikenaga

[11] Patent Number: 5,858,196

[45] Date of Patent: Jan. 12, 1999

[54] METHOD OF CONTROLLING COMPONENT CONCENTRATION OF PLATING SOLUTION IN CONTINUOUS ELECTROPLATING

[75] Inventor: Yuji Ikenaga, Kurashiki, Japan

[73] Assignee: Kawasaki Steel Corporation, Hyogo, Japan

[21] Appl. No.: 789,991

[22] Filed: Jan. 28, 1997

[30] Foreign Application Priority Data

Jan. 31, 1996 [JP] Japan ..... 8-015164

[51] Int. Cl.[6] ..... C25D 21/14

[52] U.S. Cl. ..... 205/82; 205/101

[58] Field of Search ..... 205/82, 83, 101; 204/DIG. 13

[56] References Cited

U.S. PATENT DOCUMENTS 5,368,715 11/1994 Hurley et al. ..... 205/82
5,368,716 11/1994 Kikuta ..... 205/84

FOREIGN PATENT DOCUMENTS 2-217499 8/1990 Japan .
5-320997 12/1993 Japan .

*Primary Examiner*—Kathryn C. Gorgos
*Assistant Examiner*—William T. Leader
*Attorney, Agent, or Firm*—Oliff & Berridge, PLC

[57] ABSTRACT

The present invention provides a method of controlling a component concentration of a plating solution in continuously electroplating a metallic strip while controlling a metal ion concentration of the plating solution. In the control method, when a total amount of the plating solution flowing in the series of devices varies from a preselected target value of the total bath amount, a feedback control target value of the metal ion concentration is controlled by changing it to a corrected target value of the metal ion concentration computed on the basis of a preselected target value of the metal ion concentration and said variation in the total amount of the plating solution so that the acid concentration or pH of the plating solution is kept constant. This method is capable of continuously electroplating a metallic strip with high efficiency and high precision.

6 Claims, 4 Drawing Sheets

METHOD OF CONTROLLING COMPONENT CONCENTRATION OF PLATING SOLUTION IN CONTINUOUS ELECTROPLATING

BACKGROUND OF THE INVENTION

1. Field of the Invention

The present invention relates to a method of controlling a component concentration of a plating solution in continuous electroplating which is preferably used for controlling the concentration of a plating solution in electroplating a metallic strip using an insoluble anode.

2. Description of the Related Art

A metallic strip is continuously electroplated by using a series of devices comprising a plating cell comprising an insoluble anode; a circulating tank for supplying a plating solution to the plating cell; a dissolution tank, connected to the circulating tank, for supplying to the circulating tank the plating solution in which plating ions are adjusted; a metal feeding device and an acid feeding device for feeding a metal and an acid, respectively, to the dissolution tank; and a plating system.

In this case, the concentrations of plating solution components such as metal ions, sulfuric acid, etc., which are dissolved in the plating solution, are controlled. In controlling the concentrations, in order to maintain the concentration of metal ions at a predetermined target value, the sum of an estimated metal consumption (feed forward control) computed by estimating the consumption by plating under plating conditions, and a deviation between a predetermined concentration target value and an actual concentration value is set as a feed of a metal (feedback control).

In regard to such a plating technology, for example, Japanese Unexamined Patent Publication No. 2-217499 discloses as a method of controlling a concentration of the plating solution for alloy electroplating a technology in which the plating electricity supplied is measured, and the consumption of metal ions in a plating bath is computed based on the measurement of electricity so that at least one of metal ions, free acid and water is adjusted.

Further, Japanese Unexamined Patent Publication No. 5-320997 discloses as a method of controlling a concentration of metal ions in a zinc alloy electroplating solution a technology in which the amount of a metallic salt to be supplied is determined from the sum of a reference feed of the metallic salt computed on the basis of a plating current and a dragout amount of the plating solution (amount of the plating solution which flows to the outside of the plating system), and a corrected amount of the metallic salt supplied which is computed on the basis of the component concentrations and the pH value of the electroplating solution so that the concentration of the metal ions in the electroplating solution is controlled by supplying the determined amount of the metallic salt to the electroplating solution.

In both methods of controlling a concentration in electroplating disclosed in the above publications, the target value of feedback control is set to a value fixed as a predetermined target value.

However, in continuously electroplating a metallic strip, the plated metallic strip is washed with water at the outlet of the plating cell, and the washing water and the plating solution which adheres to the metallic strip are recovered to the circulating tank. Therefore, the whole washing liquid is diluted with the water which flows in from the outside of the system, and thus excess water is evaporated to the outside by an evaporator unit to balance the washing liquid.

Even in such a case in which electroplating is carried out while balancing the inflow of water in the system and the amount of evaporation to the outside of the system, one of both amounts becomes excessive and thus causes unbalance therebetween, thereby creating a variation in the total amount of the plating solution present in the system comprising the above-described series of devices. In this case, the application of the feedback control method comprising setting the control target value to a constant and canceling a difference between the target value and the actual value of the concentration of metal ions, as disclosed in the above publications, causes the following phenomenon.

For example, when the inflow of water is larger than the evaporation of water, as shown in FIG. 4A, since the total amount of the plating solution in the system is increased to dilute the plating solution, a metal is fed by feedback control in order to supply the metal in an amount corresponding to a decrease in the metal ions between times $t_1$ and $t_2$. Furthermore, in order to maintain the metal ions concentration of the metal at a constant target value, as shown in FIG. 4B, and to maintain the concentration of sulfuric acid, which is decreased due to the consumption by dissolution reaction between the fed metal and sulfuric acid, sulfuric acid is supplied.

Although the total molar concentration is used as the concentration of metal ions here, for example, when the plating solution contains at least two types of metal ions, as an alloy plating solution containing zinc and nickel, the total molar concentration represents the total of the concentrations of these metal ions.

In the above-mentioned plating, if the washing water of the strip is discharged to the outside of the system, the metal and acid need not be supplied. However, since the plating solution contained in the washing water is disposed of, the unit consumption of the metal and acid is diminished. When the washing water is discharged after treatment, and water is discharged to the outside of the system by evaporation, the amount of the plating solution is gradually decreased, thereby increasing the concentration of metal ions. Hence, the above method of balancing the amount of the water which flows in the system and the amount of water evaporated becomes effective.

However, when the control technologies disclosed in Japanese Unexamined Patent Publication Nos. 2-217499 and 5-320997 are applied to the electroplating system comprising flowing in and out water, since the target value of feedback control is set to a constant target value, unbalance between the inflow of water from the outside and the evaporation of water to the outside causes the several problems.

The problems will be described with reference to FIG. 4. If the inflow of water from the outside is larger than the evaporation of water to the outside between times $t_1$ and $t_2$, thus diluting the plating solution, as described above, excess metal is supplied for canceling the dilution in order to keep the concentration of metal ions constant by feedback control. As a result, the excess metal supplied is dissolved in sulfuric acid by reaction formula (1) below, and thus sulfuric acid is also consumed and reduced in amount.

$$Zn+H_2SO_4 \rightarrow ZnSO_4+H_2\uparrow \quad (1)$$

When the amount of sulfuric acid is reduced, as described above, sulfuric acid is supplied in order to maintain the sulfuric acid concentration of the plating solution at a target concentration by feedback control. As a result, at time $t_2$ the total amount of the plating solution is at a maximum, but both the concentration of metal ions (total molar concentration) and the sulfuric acid concentration remain at the target values, despite the significant increase in the amount of the plating solution.

Since water is then discharged by evaporation between times $t_2$ and $t_3$, and plating is effected in order to maintain the concentration of the metal ions at the target value, at time $t_3$ the total amount of the plating solution returns to the target value, but there is no escape of excess sulfuric acid supplied for dissolving the metal. This makes it impossible to return the sulfuric acid concentration of the plating solution to the target value, as shown in FIG. 4C, and thus causes a decrease in pH of the plating solution with an increase in the concentration of sulfuric acid.

This phenomenon will be described in further detail below with reference to the case of a zinc (Zn) metal as an example. In electroplating, since plating reaction (electrodeposition reaction) represented by the following reaction formulae (2) and (3) proceeds, the amount of sulfuric acid is balanced by an increase due to plating reaction represented by reaction formula (3) and a decrease due to reaction with the supplied metal represented by reaction formula (1).

$$Zn^{2+}+2e^{-}\rightarrow Zn\downarrow \quad (2)$$

$$H_2O+SO_4^{2-}\rightarrow H_2SO_4+1/2O_2\uparrow+2e^{-} \quad (3)$$

FIG. 2 shows the conception of this relation with reference to pure zinc (Zn) plating as an example. The concentration of metal ions is shown on the ordinate, and the sulfuric acid concentration is shown on the abscissa. Both concentrations are controlled to be balanced at the intersection of both target values.

Namely, as is obvious from the above formula (2), since the excess metal supplied can be removed by consumption in plating, the concentration of metal ions can be controlled to the target value by performing plating at the same time as evaporation of water, as shown in FIG. 4B. However, in this case, at the same time, the amount of sulfuric acid is increased due to reaction represented by formula (3). Since there is no escape of the increased amount of sulfuric acid, as described above, the concentration of sulfuric acid in the plating solution is increased, i.e., the pH thereof is decreased, thereby causing various problems.

The same phenomenon is produced in alloy plating. Although contents will be partly duplicated, this alloy plating will be described below.

In the electroplating system for continuously plating a metallic strip, generally, water used for washing the surface of the plated metallic strip is recovered in the plating system, as described above. Since the plating solution is diluted with the water which flows in the system, excess water is removed by evaporation to the outside of the system by using an evaporator unit. However, the amount of evaporation cannot be continuously changed by the evaporator unit, and thus the actual value of the total amount of the plating solution (the total of the plating solution present in the plating system) inevitably varies by about 5 to 10% relative to the target value.

When the actual total amount of the plating solution is increased due to inflow of water from the outside of the system, as described above, the measurement of the concentration of metal ions ([g/l] or [mol/l]) is consequently decreased. Therefore, in this case, in order to keep the concentration of metal ions constant, it is necessary to counteract the decrease in metal ion concentration by feeding a metallic agent (for example, a metal itself, a salt thereof, an oxide thereof, or the like) containing the object metal into the plating solution.

This will be described with reference to a sulfuric acid plating solution for alloy plating as an example. In this case, it is necessary to feed Zn and Ni agents (metallic agents). In feeding such agents, when the Zn agent is ZnO, and the Ni agent is metallic Ni, the amount of sulfuric acid is decreased, i.e., the pH is increased, according to the reactions represented by the formulae (4) and (5). Thus, in order to maintain the concentration of sulfuric acid (or pH) at a constant value, sulfuric acid must be fed.

$$ZnO+H_2SO_4\rightarrow ZnSO_4+H_2O \quad (4)$$

$$Ni+H_2SO_4\rightarrow NiSO_4+H_2\uparrow \quad (5)$$

In electroplating Zn—Ni alloy, in general, metal (Zn, Ni) ions are consumed by electrodeposition reaction represented by the same formulae (6) and (7) below as the above formula (2) on the surface of a cathode (metallic strip), and at the same time, the amount of sulfuric acid is increased due to reaction represented by the same formula (8) below as the above formula (3) on the surface of an anode. In this alloy plating, therefore, the consumption of metal ions by plating reaction of formulae (6) and (7) is made up for by the reactions represented by the above formulae (4) and (5) so as to balance the concentration of metal ions and the concentration of sulfuric acid (or Ph).

$$Zn^{2+}+2e^{-}\rightarrow Zn\downarrow \quad (6)$$

$$Ni^{2+}+2e^{-}\rightarrow Ni\downarrow \quad (7)$$

$$H_2O+SO_4^{2-}\rightarrow H_2SO_4+1/2O_2\uparrow+2e^{-} \quad (8)$$

Therefore, when the total amount of the plating solution is increased by the inflow of water from the outside of the system, feeding of the metallic agents and sulfuric acid in order to keep the component concentrations constant makes excessive both the metal ions and sulfuric acid at the time the total amount of the plating solution is then returned to the target value by evaporating water. Thus, the feeding of the metals and sulfuric acid must be stopped. In this case, since not only the supply of metal ions according to the above formulae (4) and (5) is stopped, but the metal ions are consumed by continuing plating according to the formulae (6) and (7), the amount of metal ions can steadily be reduced. However, since the amount of sulfuric acid is not reduced according to formulae (4) and (5), but it is increased according to the above formula (8) by continuing plating for returning the concentration of metal ions to an appropriate value, similarly, the concentration of sulfuric acid is further increased, and the pH is decreased.

SUMMARY OF THE INVENTION

The present invention has been achieved for solving the above problems of the conventional technologies. An object of the present invention is to provide a method of controlling the concentration of a solution component for plating a metallic strip in which, when the total amount of a plating solution changes with inflow and outflow of water in a plating system, and the concentration of a plating solution thus changes, for example, even if the inflow of water in the system causes an increase in the total amount of the plating solution and thus a decrease in the concentration of the plating solution due to dilution thereof, it is possible to prevent the occurrence of an abnormal decrease in pH or an abnormal increase in the acid concentration by feedback control of the concentration of metal ions.

In order to achieve the object, in accordance with an aspect of the present invention, there is provided a method of controlling the concentration of a component of a plating solution when continuously electroplating a metallic strip under control of the concentration of metal ions by using a series of devices comprising a plating cell for plating using an insoluble anode, a circulating tank for supplying the plating solution to the plating cell, a dissolution tank connected to the circulating tank so as to supply the plating solution in which plating ions are adjusted, a metal feeding device and an acid feeding device for feeding a metal and an acid, respectively, to the dissolution tank, and an evaporator unit for evaporating water; the method comprising, when the total amount of the plating solution flowing in the series of devices varies from the previously set target value of the total amount of the plating solution, controlling the concentration of metal ions by setting the feedback control target value of the concentration of the metal ions to a corrected target value thereof which is computed on the basis of the preselected target value of the concentration of metal ions and variation in the total amount of the plating solution so that the acid concentration of the plating solution is maintained at a constant.

In accordance with another aspect of the present invention, there is provided a method of controlling the concentration of a component of a plating solution in continuous electroplating, the method comprising, when the total amount of the plating solution flowing through the system varies from the previously set target value of the total amount of the plating solution, controlling the concentration of metal ions by setting the feedback control target value of the concentration of the metal ions to a corrected target value thereof which is computed on the basis of the target value of the concentration of metal ions and a variation in the total amount of the plating solution so that the pH value of the plating solution is maintained at a constant.

Other constructions of the present invention and variations will be made apparent from the detailed description below.

DETAILED DESCRIPTION OF PREFERRED EMBODIMENTS

The inventors found that, in continuously electroplating a metallic strip by an electroplating system having inflow and outflow of water using an insoluble anode, when the inflow of water and the evaporation of water are unbalanced to cause a variation in the concentration of the plating solution, it is very important for plating with high precision to control the pH value of the plating solution to an appropriate value, rather than the concentration of metal ions.

The present invention has been achieved on the basis of the above finding. When the actual value of the total amount of the plating solution present in the plating system changes from the target value of the amount of the plating solution which represents the target value of the total amount of the plating solution, the feedback control target value of the concentration of metal ions is set to a corrected target value which is computed on the basis of the target value of the concentration of metal ions and the variation of the total amount of the plating solution so that the pH value or the acid concentration of the plating solution is maintained at a constant.

Figure 2:
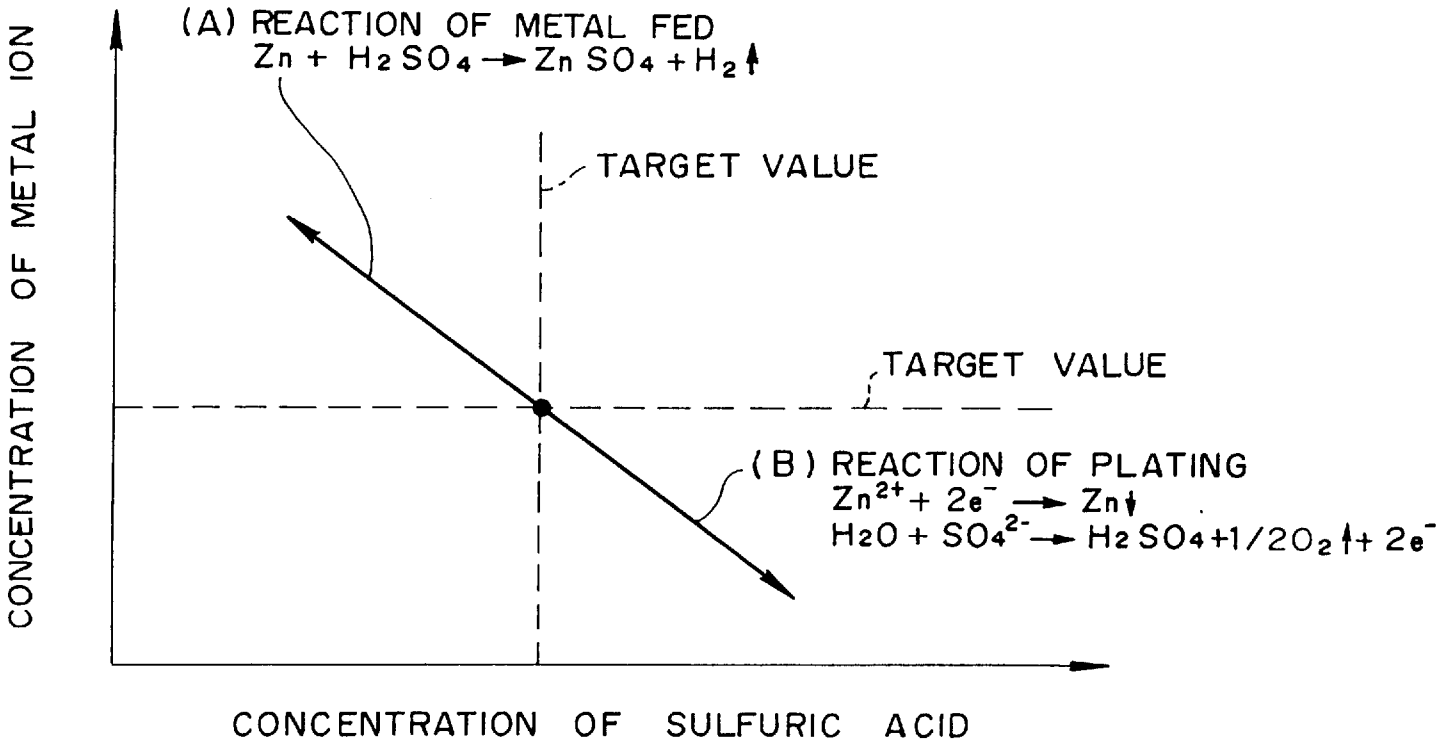
FIG. 2 is a diagram illustrating the relation between the component concentration and the concentration of sulfuric acid in a plating system using an insoluble anode.

Namely, in consideration of the relation between the concentration of metal ions and the concentration of sulfuric acid shown in FIG. 2, for example, when the total amount of the plating solution is increased due to the inflow of water, and the plating solution is consequently diluted, an excess of metal corresponding to the dilution is not fed, but the amount of sulfuric acid is increased by effecting the plating reaction represented by the above formula (3) to make constant the concentration of sulfuric acid so that the pH thereof is maintained at a constant.

Figure 1:
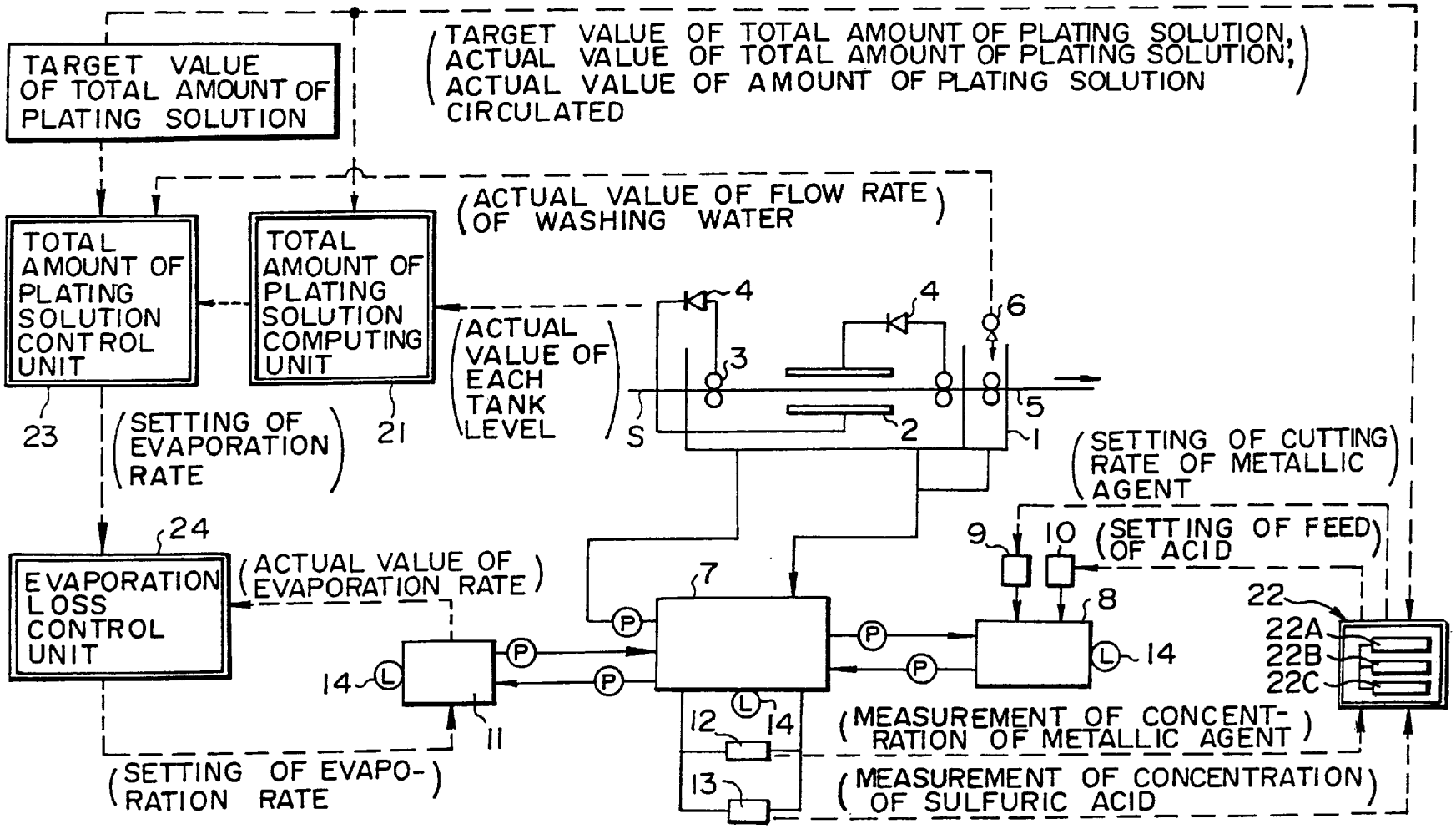
FIG. 1 is a schematic drawing illustrating an example of an apparatus for carrying out a method of the present invention.

An embodiment of the present invention will be described in detail below with reference to the drawings. FIG. 1 is a schematic drawing illustrating an example of apparatus for carrying out the method of the present invention.

A pair of insoluble anodes 2 and conductor rollers 3 are provided with a metallic strip S held therebetween which is continuously moved in a plating solution stored in a plating cell 1. The plating cell 1 further comprises a rectifier 4, wringer rolls 5, and a washing device 6 provided on the outlet side thereof, for washing out the plating solution which adheres to the metallic strip S. The plating cell 1 and a circulating tank 7 for circulating and supplying the plating solution to the plating cell 1 are connected to each other by pipes. The circulating tank 7 and a dissolution tank 8 for feeding to the circulating tank 7 the plating solution in which a metal and an acid are mixed and dissolved are connected to each other. The dissolution tank 8 comprises a metal feeding device 9 and an acid (sulfuric aid or the like) feeding device 10 for supplying a metal and an acid, respectively, to the plating solution so as to control the concentrations thereof. The circulating tank 7 is connected to an evaporator unit 11 for evaporating excess water which flows in from the outside of the system. The circulating tank 7 is provided with a liquid analyzer 12, a plating solution densitometer 13 and a level meter 14. Each of the dissolution tank and the evaporator unit is provided with a level meter 14. Besides these devices, a pump P is mounted to the pipes for connecting the respective tanks.

The control relation is described below. In each control period, a total amount of the plating solution computing unit 21 computes the total amount of the plating solution on the basis of the actual value of the level rate measured by the level meter 14 of each tank which is installed in the plating system. This computed value is transmitted as the measurement of the total amount of the plating solution to a plating solution concentration control unit 22. The plating solution concentration control unit 22 comprises a control operation unit 22A, a concentration feedback control unit 22B and a concentration feed forward control unit 22C. In the concentration control unit 22, the feed of a metallic agent is determined so that the concentration of metal ions is controlled to a corrected target value CTCs of the concentration of metal ions which is computed on the basis of the input measurement and the previously set target value of the total amount of the plating solution. A feeding command signal is output to the metal feeding device 9 in the plating system so as to feed a metallic agent. In the plating solution concentration control unit 22, in each control period, the result of measurement of the concentration of sulfuric acid in the plating solution is input from a plating solution densitometer 13 so that the feed of a sulfuric acid agent is determined on the basis of the measurement input. Similarly, a feeding command signal is also output to the acid feeding device 10 in the plating system. The feed of the sulfuric acid agent may be determined by using the pH value measured by the pH meter.

At the same time, the measurement of the total amount of the plating solution determined by the total amount of the plating solution computing unit 21 is input to a total amount of the plating solution control unit 23. The total amount of the plating solution control unit 23 outputs a setting of the evaporation rate which is determined from the sum of the feedback control amount based on a deviation from the target value of the total amount of the plating solution and the feed forward control amount based on the actual value of the flow rate of washing water from the washing device 6 to an evaporation control unit 24 for the evaporator device 11 so that the deviation of the total amount of the plating solution is canceled by evaporating water of the plating solution.

In the plating control apparatus, when the total amount of the plating solution in the plating system varies, the target value of the concentration of metal ions for feedback control of the concentration of metal ions is set to the corrected value in the concentration feedback control unit 22B of the plating solution concentration control unit 22. At this time, when the plating solution is a sulfuric acid bath, the corrected target value CTCs (mol/l) of the concentration of metal ions is computed by the following equation (9):

$$CTCs=CTMs\times(Vr+Vs-Va)/Vr+(CAs/Ma)\times(Vs-Va)/Vr \quad (9)$$

CTCs: corrected target value of the metal ion concentration

CTMs: set target value of the concentration of metal ions [mol/l]

Vs: target value of the total amount of the plating solution [$m^3$]

Va: total amount of the plating solution [$m^3$]

Vr: amount of the plating solution circulated [$m^3$]

CAs: target value of the concentration of sulfuric acid [g/l]

Ma: molecular weight of sulfuric acid

In the above equation (9), the total amount Va of the plating solution represents the total of the plating solution actually present in the plating system, and is indicated by the actual computed value determined by computation from the measurement. A difference between the total amount Va of the plating solution and the target value Vs of the total amount of the plating solution corresponds to a variation in the amount of the bath.

The amount Vr of the plating solution circulated represents the amount of the plating solution actually circulated in the plating system. When the total amount Va of the plating solution is circulated, Va=Vr. When a part of the plating system is bypassed, and when no plating solution is circulated in the bypass portion, the amount obtained by subtracting the amount of the plating solution in the non-circulation portion from the total amount Va of the plating solution corresponds the amount Vr of the plating solution circulated.

The total amount Va of the plating solution is basically determined by computation on the basis of the actual value measured by the level meter 14 in the total amount of the plating solution computing unit 21. However, when the amount of the plating solution in a pipe of a unit other than the circulating tank 7 or an unmeasured unit varies, the actual level of the circulating tank 7 also varies. Therefore, the amounts of the plating solutions in pipes and unmeasured units are computed on the basis of equipment constants according to the operation conditions of the pump, etc. Furthermore, the amount Vr of the plating solution circulated is determined by subtracting the amount of the plating solution which is not circulated from the total amount Va of the plating solution in accordance with the operation conditions of the pump, the conditions of the bypass valve, and so on in the total amount of the plating solution computing unit 21.

The set target value CTMs of the concentration of metal ions is a target value to be set for feedback control of the component concentration when the total amount of the plating solution is close to the target value Vs.

The above equation (9) is derived from the following equation (10) on the assumption that the concentration of the amount (Va−Vr) of the plating solution which is not circulated is kept at the preselected target value for the sake of simplifying computation.

$$CTMs\times Vs+(CAs/Ma)\times Vs=CTCs\times Vr+CTMs\times(Va-Vr)+(CAs/Ma)\times Va \quad (10)$$

In the above equation (10), the left side indicates the sum of the amount of metal and the amount of sulfuric acid when the amount of the plating solution is the target value Vs of the total amount of the plating solution, and when both the concentration of metal ions and the concentration of sulfuric acid are the target values. The right side indicates the sum of the amount of metal and the amount of sulfuric acid when the amount of the plating solution varies to the total amount Va, and when the concentration of metal ions in the amount Vr circulated of the total amount Va is set to the corrected target value CTCs while the concentration of sulfuric acid is maintained at the target value. This equation is established on the assumption that the sum-of the sulfate group ($SO_4^{2-}$) contained in a metal sulfate and the sulfate group contained in sulfuric acid is kept constant. If the equation (10) is arranged with respect to CTCs, the above equation (9) is obtained.

The corrected target value CTCs of the concentration of metal ions computed by equation (9) as described above is output to the concentration feedback control unit 22B from the control operation unit 22A in the concentration control unit 22 so that the feedback control unit 22B uses the corrected target value CTCs as the target value of feedback control of the metal ion concentration to determine a deviation of concentration from the actual concentration input from the liquid analyzer 12 when the total amount of the plating solution varies from the target value of the total amount. On the other hand, in the concentration feedback control unit 22*c*, the metal consumption estimated as consumption by plating is determined based on the estimation computation information given as plating conditions.

Then, the metal feeding rate determined on the basis of the sum of the estimated metal consumption and the concentration deviation is output to the dissolution tank 8 and set therein. At the same time, the feed of sulfuric acid is determined and set so that the concentration of sulfuric acid is always maintained at the target value CAs by the same method as described above.

As described above, when the amount of water flowing in from the outside of the system is greater than the evaporation of water to the outside, since the plating solution is diluted, the set target value of the metal ion concentration is decreased. Conversely, when the amount of water flowing in from the outside of the system is less than the evaporation of water to the outside, since the plating solution is concentrated, the operation is performed for increasing the set target value of the metal ion concentration.

The above-mentioned operations of adjusting the metal feed so as to suppress excessive feeding of a metal can control the concentration of sulfuric acid (concentration of hydrogen ions: $H^+$) and the pH of the plating solution to constant values against the external effect of a change in balance between water inflow and outflow.

Specific embodiments of the present invention will be described in detail below.

Embodiment 1

In the conventional method described above with reference to FIG. 4, when the plating solution is diluted by about 5% due to inflow of water, if the concentration of metal ions is set to the target value at the time the target value Vs of the total amount of the plating solution is finally obtained at the completion of the operation of evaporating water, a pH of 1.4 at time $t_1$ before water flows in is sometimes decreased to 1.0 at time $t_3$ after evaporation is completed.

Figures 3A, 3B, 3C:
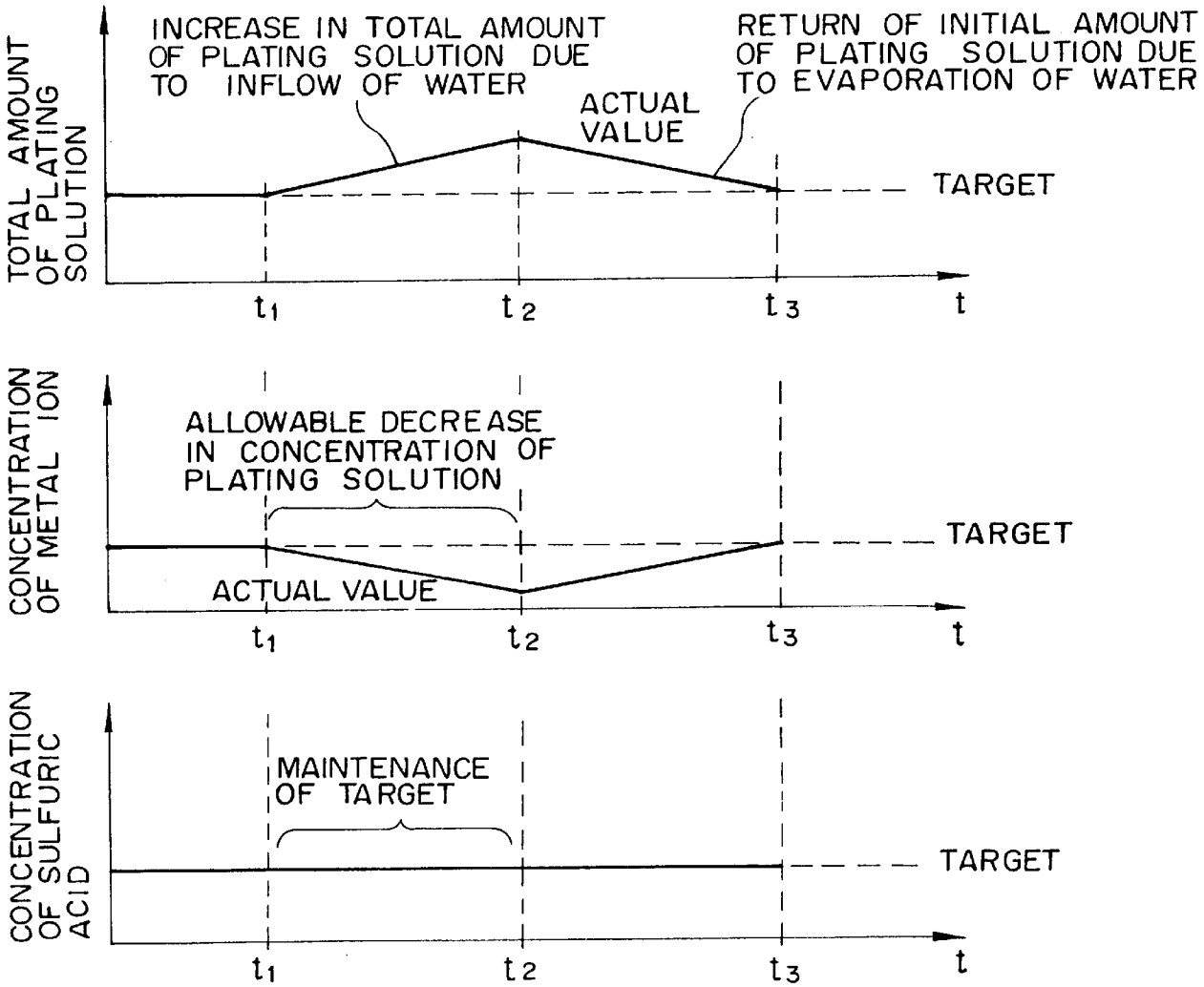
FIGS. 3A to 3C are diagrams illustrating the effect of the present invention.

FIG. 3 is a diagram showing the effect of the present invention. FIG. 3A shows the case wherein the total amount of the plating solution varies in the same manner as the conventional method shown in FIG. 4A. In this state, when the present invention is carried out, the concentration of metal ions and the concentration of sulfuric acid change as shown in FIGS. 3B and C, respectively.

Figure 4A:
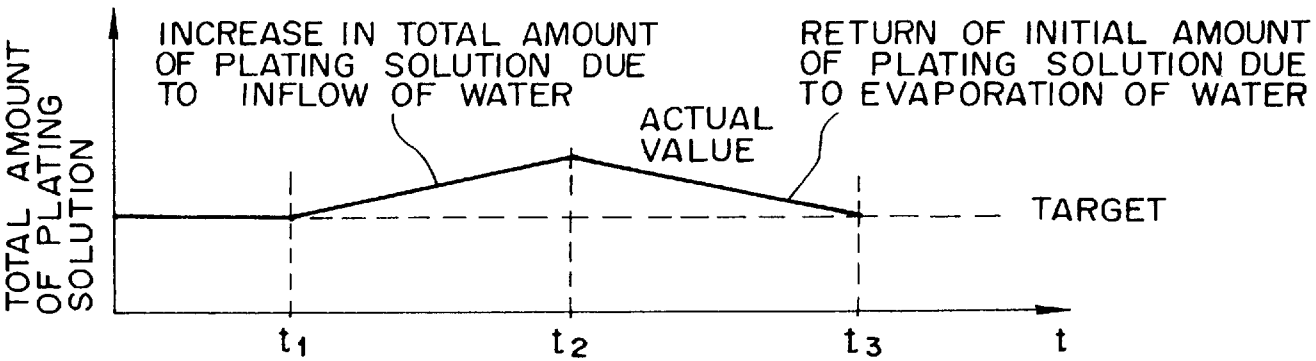
FIG. 4A PRIOR ART
FIGS. 4A to 4C are diagrams illustrating the problems of a conventional control method.
Figure 4B:
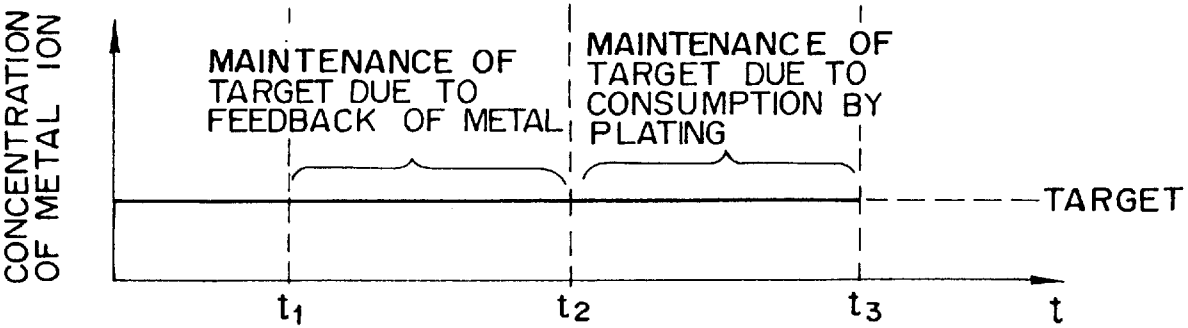
FIG. 4B PRIOR ART
Figure 4C:
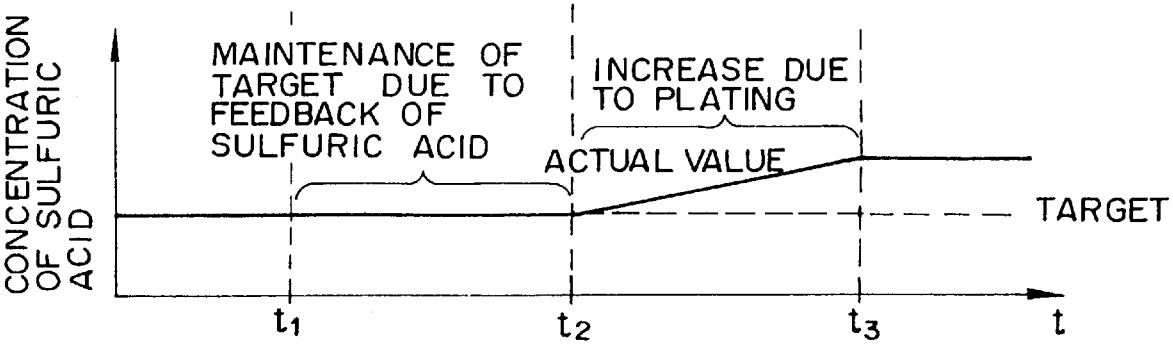
FIG. 4C PRIOR ART

In this embodiment, during the time the amount of the plating solution varies due to dilution of the plating solution with the inflow of water, as in the conventional method shown in FIG. 4A, while the concentration of metal ions decreases, as shown in FIG. 4B, feedback control of the metal ion concentration is performed with the corrected target value of the metal ion concentration computed by equation (9). This can suppress excessive feeding of a metal to intentionally decrease the metal ion concentration by a degree corresponding to the dilution of the plating solution, keep the concentration of sulfuric acid constant during a change in the amount of the plating solution, and prevent an abnormal decrease in the concentration of sulfuric acid even when the amount of the plating solution is later returned to the target value by evaporation at time $t_3$.

As a result of detailed examination, the inventors found that the concentration of sulfuric acid (pH) of the plating solution is a factor changing the plating efficiency represented by a ratio between the amount of plating deposit based on the Faraday's theory and the actual amount of plating deposit, and thus greatly affects the plating efficiency. It was also made apparent that, in plating an alloy of Zn and Ni, the plating efficiency is an important factor changing the Ni content.

Therefore, this embodiment is capable of stabilizing the concentration (pH) of sulfuric acid even if the amount of the plating solution is varied due to inflow of water or the like, thereby enabling an attempt to stabilize the amount of plating deposit and the Ni content.

Even when the amount of the plating solution varies and when the amount of the plating solution returns to the target value, it is possible to prevent an abnormal increase in sulfuric acid concentration, thereby enabling an attempt to reduce the electric power unit of plating (suppress a decrease in the plating efficiency).

Embodiment 2

In this embodiment, in a method of controlling alloy plating using at least two metallic materials, the feed of each of the metallic materials is set so that the ratio of the concentrations of metal ions is a target value.

Namely, in control of the concentration of an alloy-type electroplating solution, the ratio of the concentrations of metal ions and the concentration (or pH) of sulfuric acid can controlled independently. However, the concentration of metal ions and the concentration (or pH) of sulfuric acid are interfered with each other as shown by the above reactions (4) to (8) unless an alkali agent is added. However, this increases the amount of plating solution.

As described above, as a result of detailed examination of the factor affecting the plating efficiency (the ratio of the actual deposit to the theoretical metal deposit determined by the Faraday's theoretical equation) in electroplating, the inventors found that, although the plating efficiency is hardly affected by a variation in the metal ion concentration within the range of ±10%, an increase in the concentration of an acid (e.g., sulfuric acid) causes a decrease in plating efficiency, thereby causing deterioration in the electric power unit of plating. The actual analysis of operation data indicated that if the pH is decreased by 0.1, the plating efficiency is decreased by about 2.5%.

As a result of further analysis of actual operation data for examining the influence on the plating efficiency, it was found that, if the ratio of metal ion concentrations is increased by 4% from the target value, the plating efficiency is decreased by about 6%, and if the alloy ratio of the deposit is increased by 7% from the target value, the plating efficiency is deceased by about 10%. It was thus found to be important that, in controlling the concentration of an alloy-type electro-plating solution such as a Zn—Ni type, like the concentration (or pH) of sulfuric acid, the ratio of metal ion concentrations is controlled in preference to the concentration of metal ions.

The second embodiment was achieved on the basis of the above findings. Zn—Ni alloy electroplating in a sulfuric acid bath will be described in detail as an example of the second embodiment with reference to FIG. 1.

In this embodiment, a metallic strip is continuously plated with a Zn—Ni alloy while being moved in a plating bath provided with an insoluble anode by using the plating apparatus shown in FIG. 1. During plating, even if the total amount of the plating solution varies, the component concentrations of the plating solution can be appropriately controlled along the flow of processing shown by arrows in FIG. 1 on the basis of the measurement of the total amount of the plating solution present in the plating system.

Description will now be made of each operation up to computation of the feed of a metallic agent and the feed of a sulfuric acid agent which is carried out by the concentration control unit 22.

In this embodiment, even if the total amount of the plating solution varies, the set target value of the metal ion concentration is changed to the corrected target value CTCs of metal ion concentration which changes in accordance with the measured total amount of the plating solution so that the total amount of the metal ions present in the plating system is kept constant. This will be described in detail below.

The metal ion concentration ([g/l] or [mol/l]) is defined as the amount of metal ions per unit bath amount [l]. When the total amount of the plating solution is increased or decreased, if the concentration is the same, the total amount of metal ions is increased or decreased.

Therefore, when the total amount of the plating solution varies, the corrected target value CTCs of the concentration of metal ions for keeping the total amount of metal ions constant can be determined so that the following equation

(11) is established. Although the symbols used in equation (11) represent substantially the same meanings as those in the above equation (9), the symbols including new ones are described again below for the sake of facilitating comprehension.

$$CTMs \times Vs + (CAs/Ma) \times Vs = CTCs \times Va + (CAs/Ma) \times Va \quad (11)$$

CTMs=Zns/Mz+Nis/Mn

Zns: target value of Zn ion concentration [g/l]

Nis: target value of Ni ion concentration [g/l]

Mz: atomic weight of Zn

Mn: atomic weight of Ni

Vs: target value of the total amount of plating solution [$m^3$]

CAs: target value of the sulfuric acid concentration [g/l]

Va: total amount of the plating solution [$m^3$]

Ma: molecular weight of sulfuric acid

Therefore, the corrected target value CTCs can be determined by the following equation (12). This equation (12) corresponds to the above equation (9) when Vr=Va, i.e., when the total amount of the plating solution is circulated.

$$CTCs = (CTMs + CAs/Ma) \times Vs/Va - CAs/Ma [\text{mol/l}] \quad (12)$$

Control using the metal ion concentration which is changed to the corrected target value CTCs of the metal ion concentration determined by the above equation (12) is capable of suppressing excessive feeding of a metal even if the total amount of the plating solution is increased. It is also possible to suppress a decrease of sulfuric acid by inhibiting the reactions shown by equations (4) and (5), thereby suppressing excessive feeding of sulfuric acid.

When the pH is used in the above equations (11) and (12) in place of the concentration of sulfuric acid, the target value pHs of pH determined by the following conversion equation (13) may be used.

$$pHs = -a \times \log \{(Mh/Ma) \times CAs\} + b \quad (13)$$

wherein Mh is the molecular weight of $H_2$, and each of a and b is a conversion factor (e.g., a=1.37, b=0.59).

Description will now be made of the procedure of computation of the feed of the metallic agent to the plating system required for control using the metal ion concentration which is changed to the corrected target value.

The consumption rates of metal ions consumed by the plating reaction (electrodeposition reaction) according to the formulae (6) and (7), i.e., the consumption rate Gz of Zn ion and the consumption rate Gn of Ni ion, are determined by the following equations (14) and (15), respectively.

$$Gz = J \times (\eta/kF) \times (1 - \epsilon N) \times (Mz/2) \times 3600 [kg/h] \quad (14)$$

$$Gn = J \times (\eta/kF) \times \epsilon N \times (Mn/2) \times 3600 [kg/h] \quad (15)$$

J: plating electric current [kA]

η: plating efficiency kF: Faraday constant

EN: Ni content of Zn—Ni alloy deposit

Mz: atomic weight of Zn

Mn: atomic weight of Ni

The feeds FFZ and FFN for feed forward control of Zn and Ni agents according to the equations (14) and (15) are then determined by the following equations (16) and (17), respectively.

$$FFZ = Gz/\lambda z [\text{kg/h}] \quad (16)$$

$$FFN = Gn/\lambda n [\text{kg/h}] \quad (17)$$

λz: Zn content of Zn agent

λn: Ni content of Ni agent

On the other hand, a deviation ΔCTM of metal ion concentration is determined from the measured metal ion concentration CTMm and the corrected target value CTCs of the metal ion concentration. The feeds FBZ and FBN for feedback control of the Zn and Ni agents required for canceling the deviation are then determined by the following equations (18) and (19), respectively, in which the target value of the ratio of metal ion concentrations is taken into account.

$$FBZ = \Delta CTM \times (1 - CMNs) \times Mz \times Va/\lambda z/t_{fb} [kg/h] \quad (18)$$

$$FBN = \Delta CTM \times CMNs \times Mn \times Va/\lambda n/t_{fb} [kg/h] \quad (19)$$

ΔCTM=CTCs−CTMm

CTMm: measurement of metal ion concentration [mol/l]

CTMm=Zn/Mz+Ni/Mn

Zn: measurement of Zn ion concentration [g/l]

Ni: measurement of Ni ion concentration [g/l]

CMNs: target value of the ratio of metal ion concentration

CMNs=Nis/Mn/CTMs $t_{fb}$: FB control period [h]

The total feeds TZ and TN for controlling the Zn and Ni agents are then determined by the following equations (20) and (21). The concentration control unit 22 outputs a command signal to the metal feeding device 9 of the plating apparatus to feed a corresponding amount of each metallic agent.

$$TZ = FFZ + g_{fbz} \times FBZ [kg/h] \quad (20)$$

$$TN = FFN + g_{fbn} \times FBN [kg/h] \quad (21)$$

wherein $g_{fbz}$ is a FBZ gain, and $g_{fbn}$ is a FBN gain.

Each of the metallic agents is fed in the total control feed, and at the same time, the concentration of sulfuric acid is measured. At this time, the feedback control feed FBH of sulfuric acid is determined by the following equation (22) on the basis of the concentration deviation from the target value, and the concentration control unit 22 outputs a feeding command to the acid feeding device 10 of the plating apparatus.

$$FBH = g_{fbh} \times (CAs - CA) \times Va/\gamma a/\lambda a [m^3] \quad (22)$$

$g_{fbh}$: FBH gain

CA: measurement of concentration of sulfuric acid [gil]

γa: specific gravity of sulfuric acid agent

λa: content of sulfuric acid agent

In this embodiment, the feeding rates of the Zn and Ni agents are controlled in accordance with the total control feeds TZ and TN which are computed by the above equations (20) and (21), respectively, so that the total amount of metal ions can be controlled to a constant value, while the total amount of the plating solution varies. It is thus possible to prevent excessive feeding of sulfuric acid even if general feedback control of the concentration (or pH) of sulfuric acid according to the equation (22) is performed.

As described above, in this embodiment, for example, when the total amount of the plating solution varies within the range of about ±5%, if the total amount of metal ions is controlled to a constant value during a change of the total amount of the plating solution, the concentration of metal ions varies within the range of ±5%, but this variation hardly affects the plating efficiency.

In addition, although the metal ion concentration varies, the ratio of metal ion concentrations and the pH can be controlled with high precision. As a result of statistical analysis of actual operation data, when a reference deviation was σ, the control precisions of the ratio of metal ion concentration and the pH were $2\sigma \leqq 0.5\%$ and $2\sigma \leqq 0.07\%$, respectively.

In this way, it is possible to not only stabilize the ratio of metal ion concentrations but also control the ratio of metal ion concentrations with a high precision without increasing the concentration of sulfuric acid (or decreasing the pH). Thus, the plating efficiency and the alloy ratio of the deposit are stabilized, thereby greatly contributing to the stabilization of quality of alloy plating and a reduction in production cost (electric power unit).

Further, the stabilization of the alloy ratio of a deposit stabilizes the plating efficiency and the amount of a plating deposit. Since the concentration of an electroplating solution can be controlled under the ideal control condition in which the concentration (or pH) of sulfuric acid and the ratio of metal ion concentrations are controlled in preference to the metal ion concentration, it is possible to prevent the use of an excess agent and consequently reduce the agent cost.

Although the present invention has been described in detail above, the present invention is not limited to the embodiments, and various modifications can be made within the scope of the invention.

For example, although the above embodiments relate to a Zn electroplating solution of a sulfuric acid bath in single metal plating, and a Zn—Ni alloy electroplating solution of a sulfuric acid bath in alloy plating, the present invention is not limited to this plating, and the present invention can be applied to not only other single metal plating but also other alloy plating so long as the component concentrations of an electroplating solution are controlled.

As described above, even when the total amount of the plating solution varies due to inflow and outflow of water in the plating system, the present invention is capable of maintaining the acid concentration or pH of the plating solution to a constant value by feedback control of the component concentrations, and preventing an abnormal increase in the acid concentration or an abnormal decrease in pH. Therefore, a metallic strip can be continuously electroplated with high efficiency and high precision.

What is claimed is:

1. A method of controlling a component concentration of a plating solution in a method of continuously electroplating a metallic strip by using a series of devices comprising a plating cell for plating by using an insoluble anode; a circulating tank for supplying the plating solution to the plating cell; a dissolution tank connected to the circulating tank, for supplying the plating solution in which plating ions are adjusted; a metal feeding device and an acid feeding device for feeding at least one metal and an acid, respectively, to the dissolution tank; and an evaporator unit for evaporating water; the control method comprising:

when a total amount of the plating solution flowing in the series of devices varies from a preselected target value of the total amount of the plating solution, controlling a feedback control target value of a metal ion concentration by changing it to a corrected target value of the metal ion concentration computed on the basis of the preselected target value of the metal ion concentration and said variation in the total amount of the plating solution flowing in the series of devices, and feeding to the plating solution amounts of the at least one metal or the acid determined on the basis of the corrected target value of the metal ion concentration, so that an acid concentration of the plating solution is kept constant.

2. A method of controlling a component concentration of a plating solution in continuous electroplating according to claim 1, wherein, when sulfuric acid is used as said acid in the plating solution, the corrected target value of the metal ion concentration is computed by the following equation:

$$CTCs=CTMs\times(Vr+Vs-Va)/Vr+(CAs/Ma)\times(Vs-Va)/Vr;$$

where

CTCs: corrected target value of the metal ion concentration

CTMs: set target value of metal ion concentration

Vr: amount of the plating solution circulated

Vs: target value of the total amount of the plating solution

Va: total amount of the plating solution

CAs: target value of the concentration of sulfuric acid

Ma: molecular weight of sulfuric acid.

3. A method of controlling a component concentration of a plating solution in continuous electroplating according to claim 1, wherein, in alloy plating using at least two metals, the feeding to the plating solution of each metal is set so that the ratio of metal ion concentrations is maintained at a target value.

4. A method of controlling a component concentration of a plating solution in a method of continuously electroplating a metallic strip by using a series of devices comprising a plating cell for plating by using an insoluble anode; a circulating tank for supplying the plating solution to the plating cell; a dissolution tank connected to the circulating tank, for supplying the plating solution in which plating ions are adjusted; a metal feeding device and an acid feeding device for feeding at least one metal and an acid, respectively, to the dissolution tank; and an evaporator unit for evaporating water; the control method comprising:

when a total amount of the plating solution flowing in the series of devices varies from a preselected target value of the total amount of the plating solution, controlling a feedback control target value of the metal ion concentration by changing it to a corrected target value of the metal ion concentration computed on the basis of the preselected target value of the metal ion concentration and said variation in the total amount of the plating solution flowing in the series of devices, and feeding to the plating solution amounts of the at least one metal or the acid determined on the basis of the corrected target value of the metal ion concentration, so that a pH value of the plating solution is kept constant.

5. A method of controlling a component concentration of a plating solution in continuous electroplating according to claim 4, wherein, when sulfuric acid is used as said acid in the plating solution, the corrected target value of the metal ion concentration is computed by the following equation:

$$CTCs=CTMs\times(Vr+Vs-Va)/Vr+(CAs/Ma)\times(Vs-Va)/Vr;$$

where

CTCs: corrected target value of the metal ion concentration

CTMs: set target value of metal ion concentration

Vr: amount of the plating solution circulated

Vs: target value of the total amount of the plating solution

Va: total amount of the plating solution

CAs: target value of the concentration of sulfuric acid

Ma: molecular weight of sulfuric acid.

6. A method of controlling a component concentration of a plating solution in continuous electroplating according to claim 4, wherein, in alloy plating using at least two metals, the feeding to the plating solution of each metal is set so that the ratio of metal ion concentrations is maintained at a target value.

* * * * *